US007213869B1

(12) United States Patent
McClellan

(10) Patent No.: US 7,213,869 B1
(45) Date of Patent: May 8, 2007

(54) HOLD DOWN

(76) Inventor: Robert N. McClellan, 300 N. Budweiser Cir., Payson, AZ (US) 85541

( * ) Notice: Subject to any disclaimer, the term of this patent is extended or adjusted under 35 U.S.C. 154(b) by 0 days.

(21) Appl. No.: 11/102,513

(22) Filed: Apr. 8, 2005

(51) Int. Cl.
*E04H 15/06* (2006.01)
*E04H 15/08* (2006.01)

(52) U.S. Cl. ..... 296/161; 296/163; 248/519; 248/346.01; 248/346.03; 248/910

(58) Field of Classification Search ..... 410/80; 296/161, 163; 135/88.01, 88.03, 88.05, 88.13, 135/118, 114, 120.1; 160/DIG. 4, DIG. 5; 248/519, 523, 538, 539, 346.01, 346.03, 248/910
See application file for complete search history.

(56) References Cited

U.S. PATENT DOCUMENTS 1,985,164 A 12/1934 Green
3,302,342 A * 2/1967 Castleberry ..... 296/163
4,164,972 A 8/1979 Bennett
4,508,126 A 4/1985 Everard
4,530,389 A 7/1985 Quinn et al.
4,563,027 A 1/1986 Chechovsky et al.
4,640,332 A * 2/1987 Turner ..... 160/46
4,733,683 A * 3/1988 Pozzi ..... 160/22
4,778,142 A 10/1988 Roba
5,094,285 A 3/1992 Murray
5,354,031 A * 10/1994 Bilotti ..... 248/519
5,660,425 A * 8/1997 Weber ..... 296/163
5,669,430 A 9/1997 Malott
5,706,531 A * 1/1998 Aubertine ..... 4/498
5,924,465 A 7/1999 Malott
6,029,732 A 2/2000 Malott
6,113,054 A * 9/2000 Ma ..... 248/519
6,446,930 B1 * 9/2002 Li ..... 135/15.1
6,619,610 B1 * 9/2003 Genovese ..... 135/118
6,637,717 B2 * 10/2003 Li ..... 248/519
6,953,180 B1 * 10/2005 Ruvalcaba et al. ..... 135/118
6,981,680 B1 * 1/2006 Gordon et al. ..... 248/910
2001/0040208 A1 11/2001 Li
2004/0011941 A1 * 1/2004 Roepke et al. ..... 248/519
2005/0017148 A1 * 1/2005 Tung ..... 248/346.01
2005/0199774 A1 * 9/2005 Reese ..... 248/529

* cited by examiner

*Primary Examiner*—Jason Morrow
(74) *Attorney, Agent, or Firm*—Booth Udall, PLC

(57) ABSTRACT

A hold down may include a weight associated with a coupling mechanism that is configured to removably couple to a foot of an awning support arm assembly. An RV awning and hold down system may include: an awning assembly having at least one support arm assembly disconnected from a side of an RV; and at least one hold down comprising a weight associated with a coupling mechanism, the coupling mechanism removably coupled to a foot of the at least one support arm assembly. A method for holding an RV awning assembly in position may include: disconnecting at least one support arm assembly of the awning assembly from a side of an RV; and removably coupling a foot of at least one support arm assembly to a coupling mechanism associated with a weight of a hold down.

8 Claims, 8 Drawing Sheets

HOLD DOWN

BACKGROUND

1. Technical Field

This document relates to a hold down.

2. Background Art

When a recreational vehicle ("RV"), such as a camper, travel trailer, or motor home, is parked, an awning may be extended therefrom. In the "patio position" of the awning, each awning support arm extends diagonally downward so that its lower end is coupled to the side of the RV. In order to provide better access and to keep people from running into the diagonally extended awning support arms, RV owners try to place the awning in the "carport position". In the carport position, the lower end of each awning support arm abuts the ground and is often coupled to the ground by stakes during windy conditions for example. However, it is not possible/effective to drive stakes into the ground when the RV is parked on concrete, asphalt, gravel, sand, rocky terrain, snow-covered terrain, frozen terrain, and the like for example, so RV owners are forced to maintain the awning in the inconvenient/unsafe patio position.

SUMMARY

In an aspect, this document features a hold down for securing an RV awning in position that may include a weight associated with a coupling mechanism that is configured to removably couple to a foot of an awning support arm assembly.

Implementations may include one or more of the following. The weight may comprise a thickness that separates a top surface and a bottom surface. The coupling mechanism may comprises one of: a latch assembly coupled to the top surface of the weight, the latch assembly comprising a spring-biased catch; a spring-clip coupled to the top surface of the weight; a pair of spaced apart threaded rods extending outwardly from the top surface of the weight and a pair of threaded fasteners; a pair of spaced apart hinge pins extending outwardly from the top surface of the weight; a pair of spaced apart threaded holes defined in the top surface of the weight and a pair of threaded fasteners; a first securing track extending inwardly from a side face of the weight and defined in the top surface of the weight; a second securing track on the top surface of the weight; and a mounting bracket on the top surface of the weight. The hold down may also include a friction pad coupled to or integrally joined with one of a portion of the bottom surface of the weight, portions of the bottom surface of the weight, and the entire bottom surface of the weight. The friction pad may be one of compressible, ribbed, dimpled, and a combination thereof. The hold down may further include one of: a first retaining collar comprising a plurality of cleats, the first retaining collar removably coupled with a bottom portion of the weight; and a second retaining collar comprising a grid work, the second retaining collar removably coupled with a bottom portion of the weight. The weight may include one of: a first container having a lid pivotally coupled there to, the first container removably storing a material to achieve a desired hold down weight; a second container having a screw on lid, the second container removably storing a material to achieve a desired hold down weight; and an adjustable weight system comprising a plurality of flat weights stacked in layers to achieve a desired hold down weight. The weight may include a reversible base and the coupling mechanism may include a latch assembly comprising a spring-biased catch, the latch assembly coupled to the weight. The reversible base may include one of at least one friction pad and at least one integral, dimpled pad on one side thereof and one of at least one cleated area and at least one grid work area on an opposing side thereof. The hold down may further include a carry handle assembly. The carry handle assembly may include one of: a D-shaped handle and a securing chain, the securing chain coupled to both the handle and one of the latch assembly and the weight; and a strap handle coupled to one of the latch assembly and the weight.

In another aspect, this document features an RV awning and hold down system that may include: an awning assembly having at least one support arm assembly disconnected from a side of an RV, the at least one support arm assembly comprising a foot; and at least one hold down comprising a weight associated with a coupling mechanism, the coupling mechanism removably coupled to the foot of the at least one support arm assembly.

Implementations may include one or more of the following. The foot may include a bar and the coupling mechanism may include one of: a latch assembly coupled to the weight, the latch assembly comprising a spring-biased catch, wherein the spring-biased catch is removably coupled with the bar of the foot; and a spring-clip coupled to the weight, wherein the spring-clip is removably coupled with the bar of the foot. The foot may include opposing protruding flanges, each flange defining a through hole, and the coupling mechanism may include one of: a pair of spaced apart threaded rods extending outwardly from the weight and a pair of threaded fasteners, wherein the threaded rods extend through the holes in the flanges of the foot and the threaded fasteners are removably coupled on the threaded rods; a pair of spaced apart hinge pins extending outwardly from the weight, wherein the hinge pins extend through the holes in the flanges of the foot and are folded over; a pair of spaced apart threaded holes defined in the weight and a pair of threaded fasteners, wherein the holes in the flanges are aligned with the threaded holes in the weight and the threaded fasteners are removably coupled into the threaded holes in the weight; a first securing track defined in the weight of the hold down, wherein the foot is removably coupled into the first securing track; and a second securing track on the weight of the hold down, wherein the foot is removably coupled into the second securing track. The awning assembly may include a pair of support arm assemblies disconnected from a side of an RV and the at least one hold down may include a pair of hold downs.

In still another aspect, this document features a method for holding an RV awning in position that may include: disconnecting at least one support arm assembly of the awning assembly from a side of an RV; and removably coupling a foot of at least one support arm assembly to a coupling mechanism associated with a weight of a hold down.

Implementations may include one or more of the following. Removably coupling a foot of the at least one support arm assembly to a coupling mechanism associated with a weight of a hold down may include one of: coupling a bar of the foot with a spring-biased catch of a latch assembly coupled to the weight of the hold down; inserting a bar of the foot into a spring-clip coupled to the weight of the hold down; inserting a pair of spaced apart threaded rods extending outwardly from the weight of the hold down through corresponding holes in opposing protruding flanges of the foot and securing a fastener on each threaded rod; inserting a pair of spaced apart hinge pins extending outwardly from the weight of the hold down through corresponding holes in opposing protruding flanges of the foot and folding over the hinge pins; aligning a pair of spaced apart threaded holes defined in the weight of the hold down with corresponding holes in opposing protruding flanges of the foot and securing a fastener into each threaded hole; and inserting the foot into one of a securing track defined in the weight of the hold down and a securing track on the weight of the hold down.

These and other implementations may have one or more of the following advantages. A canopy may be safely, simply, and easily secured in or removed from the carport position on virtually any surface (e.g., concrete, asphalt, wood, rocky surfaces, or other hard surfaces, as well as on dirt, sand, snow, or other softer surfaces) during virtually any weather conditions. Hold down implementations may provide more convenience and versatility than the conventional tent stakes, screw in rods or stakes with ropes, and the like. Hold down implementations may be of a size and weight to be easily utilized by an operator and carried along during travel in any RV.

The foregoing and other aspects, features, and advantages will be apparent from the DESCRIPTION and DRAWINGS, and from the CLAIMS.

BRIEF DESCRIPTION OF THE DRAWINGS

Implementations will hereinafter be described in conjunction with the appended DRAWINGS, where like designations denote like elements, and.

DESCRIPTION OF THE INVENTION

1. Structure

Figure 1:
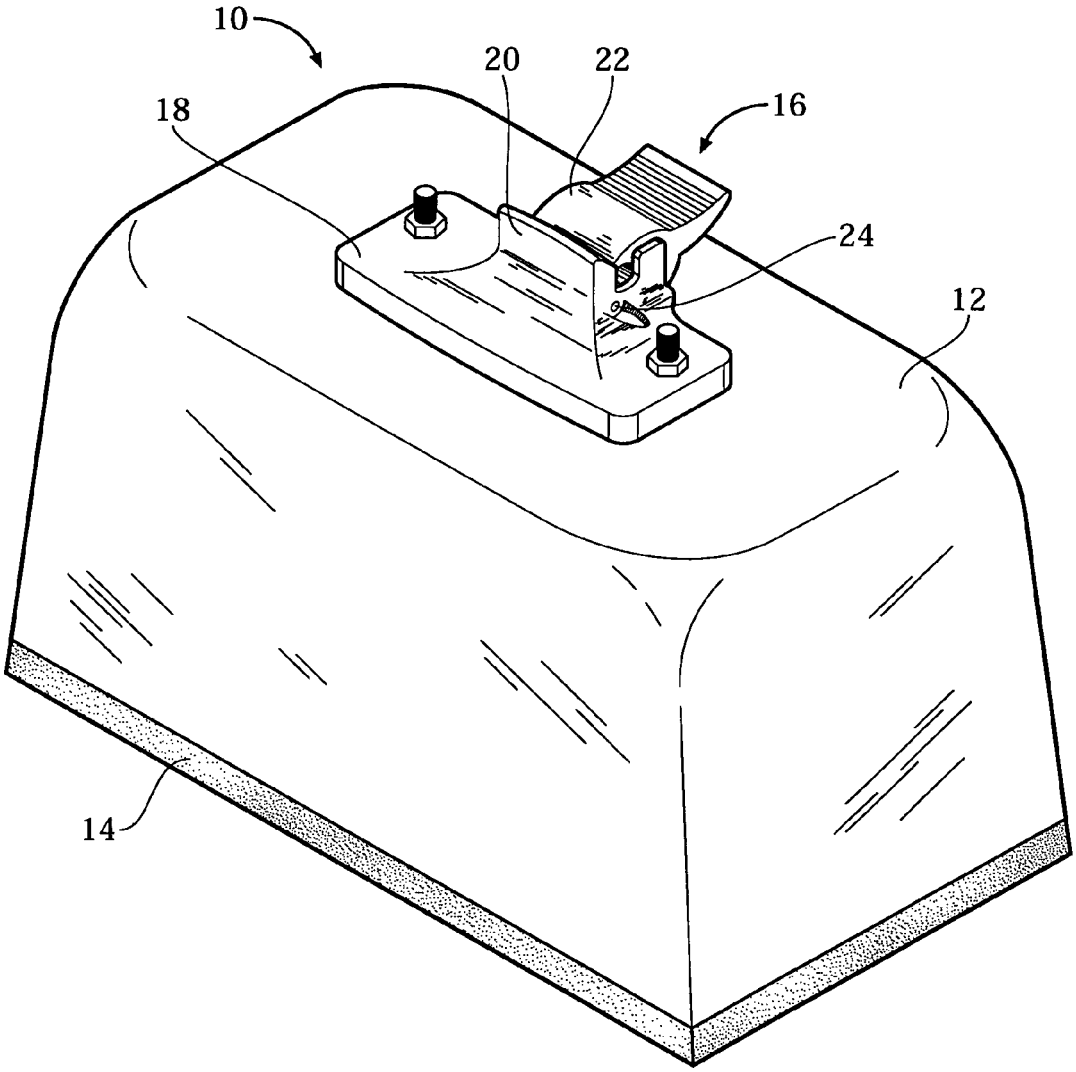
FIG. 1 is a perspective view of a hold down implementation.

There are a variety of hold down implementations. Notwithstanding, with reference to FIG. 1 and for the exemplary purposes of this disclosure, hold down 10 is an example of a hold down implementation. Hold down 10 may include weight 12, friction pad 14, and latch assembly 16.

Weight 12 may be any object used principally to exert a force by virtue of its gravitational attraction to Earth, especially an object used to hold something else down. Weight 12 may be of a size and weight to be easily carried along during travel in any RV and/or easily lifted by a person, while still being able to hold an RV awning in position. Weight 12 may have a slightly tapering right rectangular frusto-pyramidal shape. Weight 12 may have a thickness that separates a top face and a bottom face. For the attachment of latch assembly 16 as described hereinafter, the top face of weight 12 may have either a pair of spaced apart, threaded holes formed therein or a pair of spaced apart, upright, threaded rods extending outwardly therefrom.

Friction pad 14 may be configured to prevent slippage or skidding of hold down 10 when in use on hard surfaces, such as concrete, asphalt, wood, and the like surfaces that RV's typically park on. Friction pad 14 may be coupled to or integral with the bottom face of weight 12. Friction pad 14 may be compressible and/or ribbed. Friction pad 14 may cover the entire bottom face of weight 12 or only a portion or portions of the bottom face of weight 12.

Latch assembly 16 may be configured to removably couple to a foot of a lower arm of an awning support arm assembly. Latch assembly 16 may include latch bracket 18, extension bracket 20, catch 22, and pin 24.

Latch bracket 18 may be coupled to or integral with the top face of weight 12. For example, if latch bracket 18 includes a pair of spaced apart, through holes and weight 12 has a pair of spaced apart, upright, threaded rods, latch bracket 18 may be coupled to the top face of weight 12 by inserting the threaded rods through the corresponding through holes and then securing a nut, a wing nut, a thumb nut, a threaded knob, or the like on each threaded rod. Alternatively, if latch bracket 18 includes a pair of spaced apart, through holes and weight 12 has a pair of spaced apart, threaded holes, latch bracket 18 may be coupled to the top face of weight 12 by aligning the threaded holes with the corresponding through holes and then securing a bolt, a thumb screw, a screw knob, or the like into each threaded hole.

Figure 5:
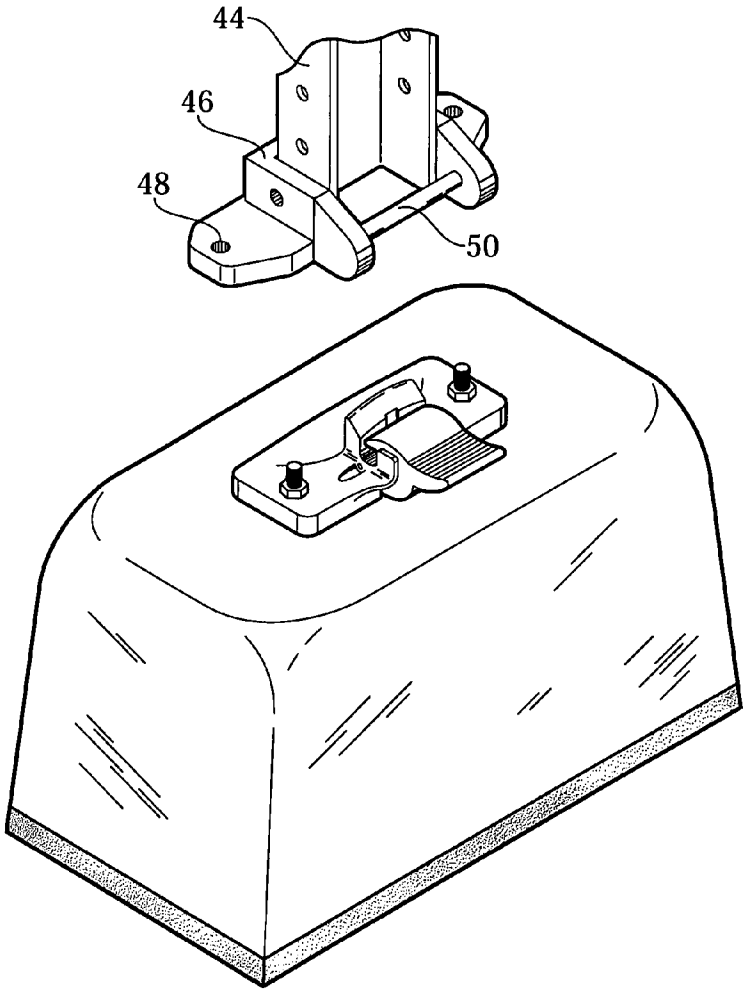
FIGS. 5–6 are portions of views of the RV awning and hold down assembly of FIGS. 3–4 respectively enlarged for magnification purposes.
Figure 6:
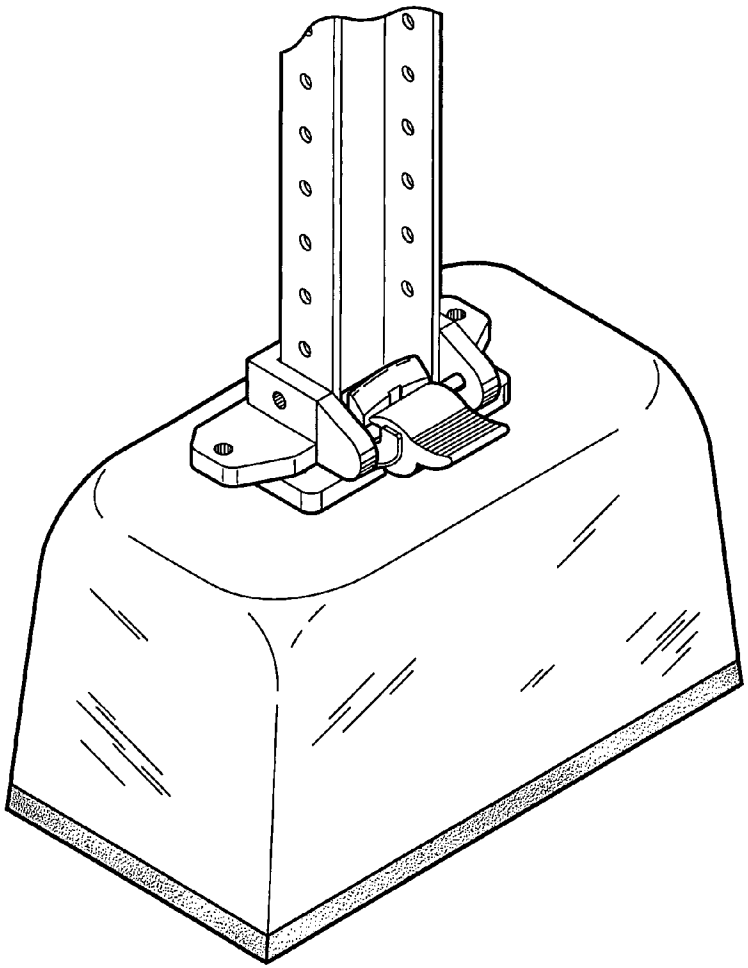

Extension bracket 20 is configured to guide bar 50 of foot 46 into a latching relationship with catch 22. Extension bracket 20 protrudes from latch bracket 18 and has a beveled top portion and a pair of opposing, offset arms. Catch 22 may be pivotally connected between the opposing arms of extension bracket 20 by pin 24, and catch 22 may include a thumb release lever, which may be quickly and conveniently moved to release bar 50 of foot 46, and an opposing hook-shaped portion configured to connect around bar 50 of foot 46. A spring normally biases catch 22 closed as shown in FIGS. 1 and 5–6. Thus, catch 22 allows bar 50 of foot 46 to be moved in contact with catch 22 and catch 22 automatically latches or grips bar 50 of foot 46.

2. Other Implementations

As mentioned earlier, many additional hold down implementations are possible.

Figure 7:
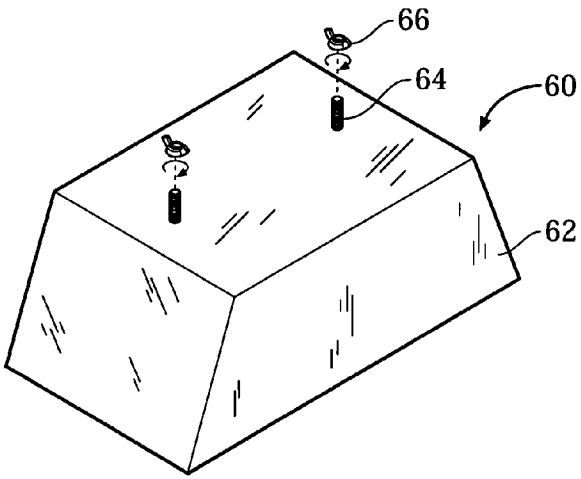

Although there are a variety of hold down implementations, for the exemplary purposes of this disclosure and referring to FIG. 7, hold down 60 is an example of a hold down implementation. Hold down 60 is similar to hold down 10 as previously described. The principal difference between them, other than the shape of their respective weights, relates to their coupling mechanisms. In particular, the coupling mechanism may include a pair of spaced apart, upright, threaded rods 64 extending from the top face of weight 62 in conjunction with wing nuts 66. Foot 46 may be removably coupled to the top face of weight 62 by inserting threaded rods 64 through corresponding opposing through holes 48 of foot 46 and then securing wing nut 66 or some other nut, thumb nut, threaded knob, or the like on each threaded rod 64.

Figure 8:
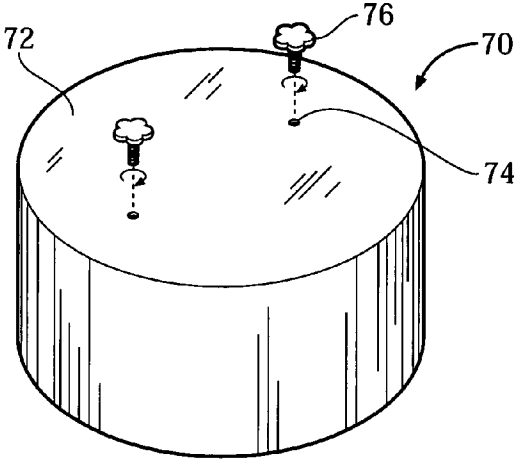
FIGS. 7–18 are perspective views of alternative hold down implementations respectively.

Although there are a variety of hold down implementations, for the exemplary purposes of this disclosure and referring to FIG. 8, hold down 70 is an example of a hold down implementation. Hold down 70 is similar to hold down 10 as previously described. The principal difference between them, other than the shape of their respective weights, relates to their coupling mechanisms. In particular, the coupling mechanism may include a pair of spaced apart, threaded holes 74 defined in the top face of weight 72 in conjunction with screw knobs 76. Foot 46 may be removably coupled to the top face of weight 72 by aligning threaded holes 74 with corresponding opposing through holes 48 of foot 46 and then securing screw knob 76 or some other bolt, thumb screw, or the like into each threaded hole 74.

Figure 9:
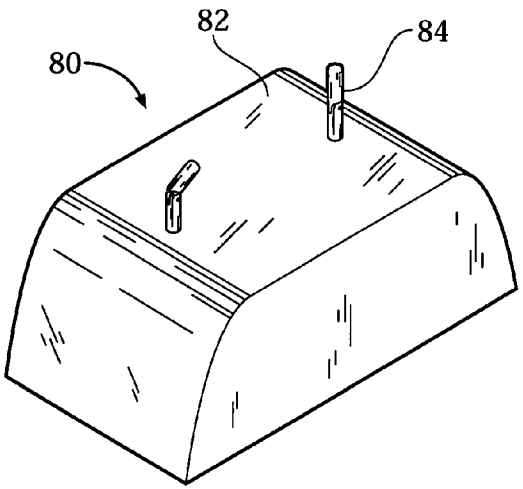

Although there are a variety of hold down implementations, for the exemplary purposes of this disclosure and referring to FIG. 9, hold down 80 is an example of a hold down implementation. Hold down 80 is similar to hold down 10 as previously described. The principal difference between them, other than the shape of their respective weights, relates to their coupling mechanisms. In particular, the coupling mechanism may include a pair of spaced apart, upright, hinge pins 84 extending from the top face of weight 82. Foot 46 may be removably coupled to the top face of weight 82 by inserting hinge pins 84 through corresponding opposing through holes 48 of foot 46 and then folding over hinge pins 84.

Figure 10:
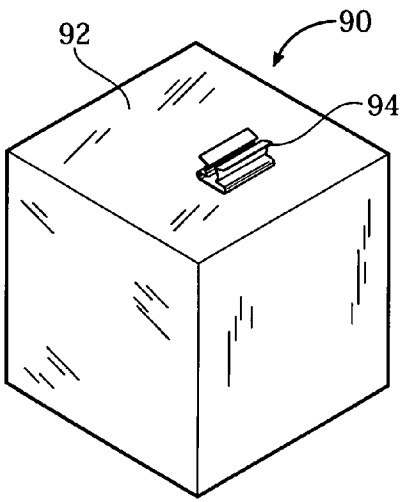

Although there are a variety of hold down implementations, for the exemplary purposes of this disclosure and referring to FIG. 10, hold down 90 is an example of a hold down implementation. Hold down 90 is similar to hold down 10 as previously described. The principal difference between them, other than the shape of their respective weights, relates to their coupling mechanisms. In particular, the coupling mechanism may include spring-clip 94 extending from the top face of weight 92. Foot 46 may be removably coupled to the top face of weight 92 by inserting bar 50 of foot 46 into spring-clip 94.

Figure 11:
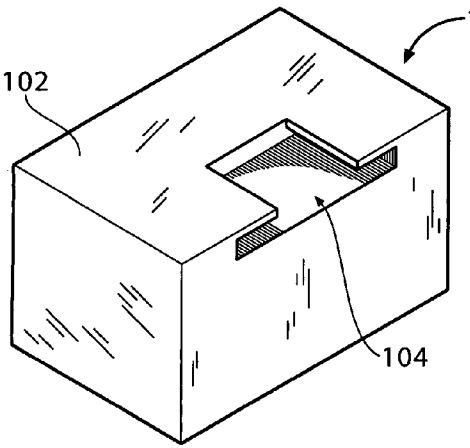

Although there are a variety of hold down implementations, for the exemplary purposes of this disclosure and referring to FIG. 11, hold down 100 is an example of a hold down implementation. Hold down 100 is similar to hold down 10 as previously described. The principal difference between them, other than the shape of their respective weights, relates to their coupling mechanisms. In particular, the coupling mechanism of hold down 100 may include securing track 104 extending inwardly from a side face of weight 102 and defined in the top face of weight 102. Securing track 104 may include a flanged channel, wherein sidewalls of the channel have inwardly protruding flange members formed on exposed ends thereof for receiving the flanges of foot 46. Thus, foot 46 may be removably coupled to weight 102 by inserting foot 46 into securing track 104. Notwithstanding, the inwardly protruding flange members of securing track 104 may each include an elongated slot there through corresponding with holes 48 in foot 46, the elongated slot allowing for variations in the spacing/width between holes 48 in foot 46. Retaining pins may then be inserted through the slots into holes 48 in foot 46 to further keep foot 46 in securing track 104. Alternatively, a spring clip may be mounted in the base of the channel of securing track 104 which may removably couple with foot 46 to further keep foot 46 in securing track 104. Furthermore, the securing track may be on the top face of weight 102.

Figure 12:
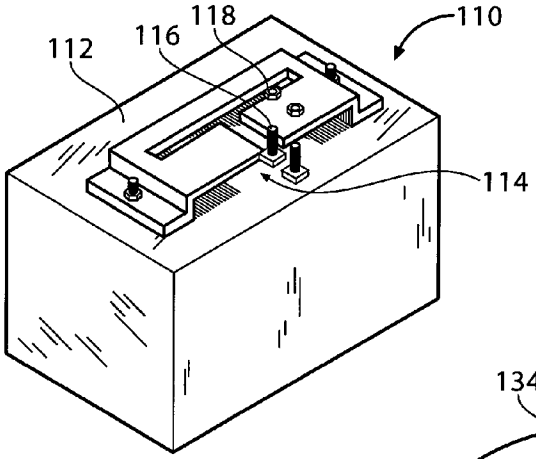

Although there are a variety of hold down implementations, for the exemplary purposes of this disclosure and referring to FIG. 12, hold down 110 is an example of a hold down implementation. Hold down 110 is similar to hold down 100 as previously described. The principal difference between them relates to their coupling mechanisms. In particular, the coupling mechanism of hold down 110 may include mounting bracket 114 on the top face of weight 112. Mounting bracket 114 may include a flanged channel, wherein sidewalls of the channel have an inwardly protruding flange member formed on exposed ends thereof for supporting the flanges of foot 46. The inwardly protruding flange members of mounting bracket 114 may each include an elongated slot there through corresponding with holes 48 in foot 46, the elongated slots allowing for variations in the spacing/width between holes 48 in foot 46. Bolts 116 and nuts 118 may then be inserted through the slots into holes 48 in foot 46 and secured by nuts 118 to keep foot 46 on mounting bracket 114.

Figure 13:
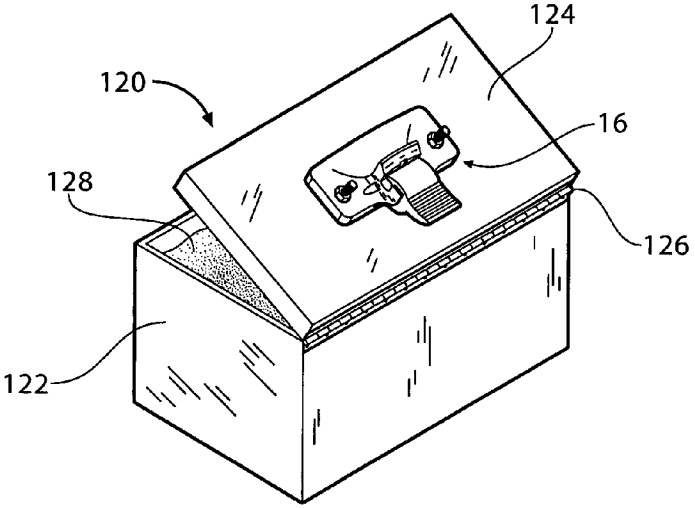

Although there are a variety of hold down implementations, for the exemplary purposes of this disclosure and referring to FIG. 13, hold down 120 is an example of a hold down implementation. Hold down 120 is similar to hold down 10 as previously described. The principal difference between them relates to their weights. In particular, the weight may include container 122 which has lid 124 pivotally coupled thereto by hinge 126. Container 122 forms a cavity for removably storing a cheap material such as sand 128 or some other ballast material such as dirt, water, stone, and the like to achieve a desired hold down weight.

Figure 14:
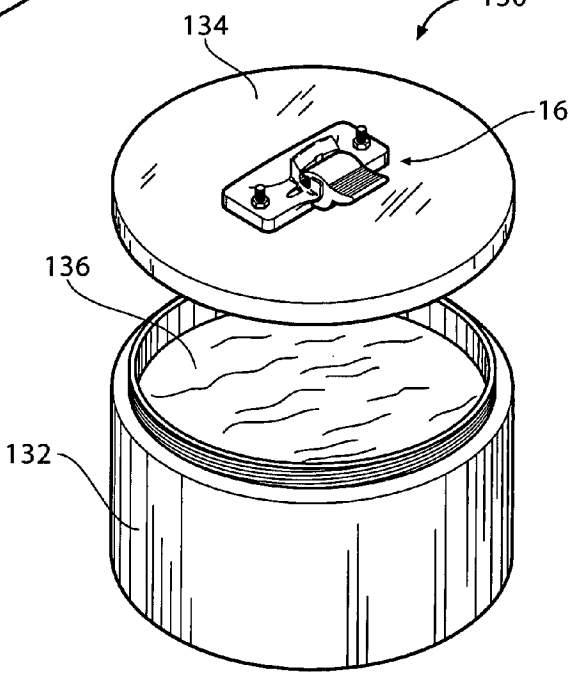

Although there are a variety of hold down implementations, for the exemplary purposes of this disclosure and referring to FIG. 14, hold down 130 is an example of a hold down implementation. Hold down 130 is similar to hold down 120 as previously described. The principal difference between them relates to their weights. In particular, the weight may include container 132 which has screw on lid 134. Container 132 forms a cavity for removably storing a cheap material such as water 138 or some other ballast material such as dirt, sand, stone, and the like to achieve a desired hold down weight.

Figure 15:
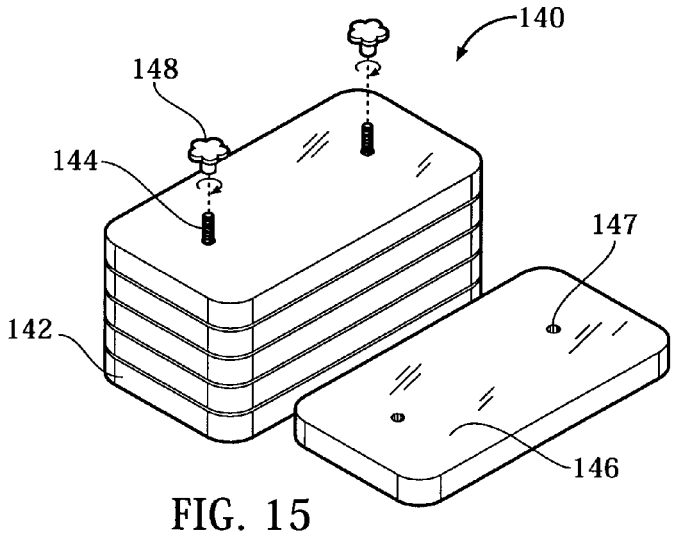

Although there are a variety of hold down implementations, for the exemplary purposes of this disclosure and referring to FIG. 15, hold down 140 is an example of a hold down implementation. Hold down 140 is similar to hold down 10 as previously described. The principal differences between them relate to their respective weights and coupling mechanisms. In particular, hold down 140 is an adjustable weight system comprised of base 142 having a pair of spaced apart, upright, threaded guide rods 144 extending from the top face of base 142. A plurality of flat weights 146 each with a pair of spaced apart guide through holes 147 may be stacked in layers to achieve the desired hold down weight. Foot 46 may be removably coupled to the top face of the last weight 146 by inserting threaded rods 144 through corresponding opposing through holes 48 of foot 46 and then securing threaded knob 148 or some other nut, thumb nut, wing nut, or the like on each threaded rod 144.

Figure 16:
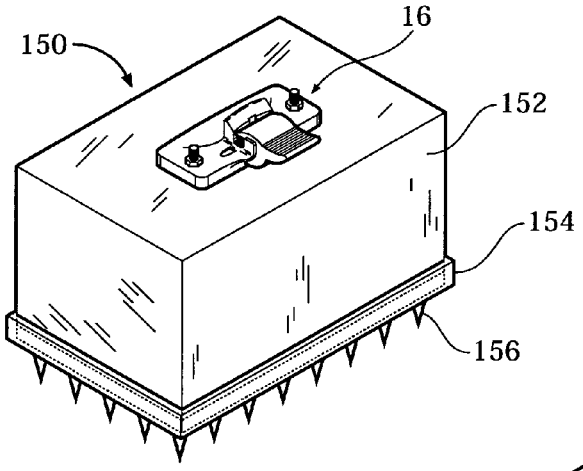

Although there are a variety of hold down implementations, for the exemplary purposes of this disclosure and referring to FIG. 16, hold down 150 is an example of a hold down implementation. Hold down 150 is similar to hold down 10 as previously described. The principal differences between them, other than the shape of their respective weights, relate to the addition of retaining collar 154. In particular, the bottom portion of weight 152 is configured to removably rest in retaining collar 154. Retaining collar 154 includes a plurality of pointed spikes or cleats 156 which provide additional stability on turf, lawn areas, other grassy surfaces, or the like for example.

Figure 17:
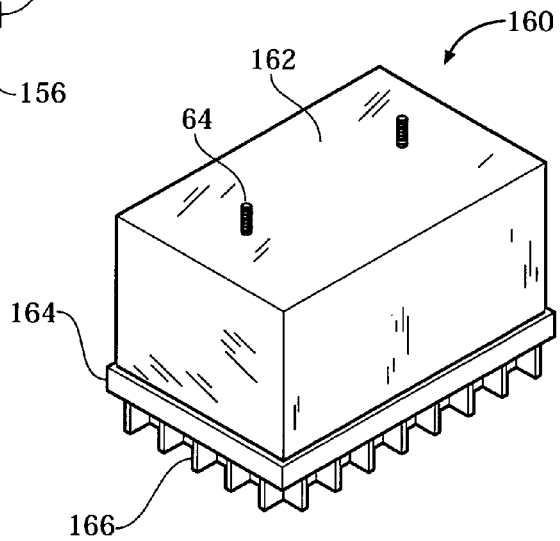

Although there are a variety of hold down implementations, for the exemplary purposes of this disclosure and referring to FIG. 17, hold down 160 is an example of a hold down implementation. Hold down 160 is similar to hold down 150 as previously described. The principal differences between them, other than the shape of their respective weights, relate to the addition of retaining collar 164. In particular, the bottom portion of weight 162 is configured to removably rest in retaining collar 164. Retaining collar 164 includes grid work 166 which provides additional stability in soft sand, loose dirt, unstable wet soil, or the like for example.

Figure 19:
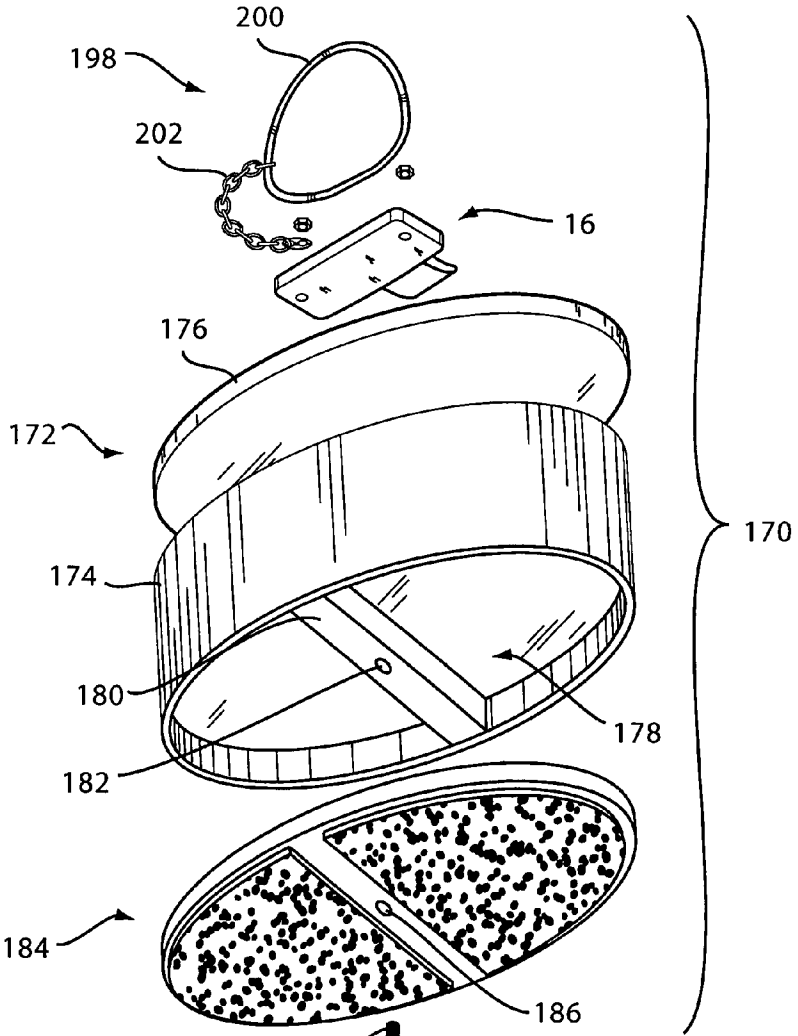
FIGS. 19–20 are exploded perspective and side views respectively of components of the hold down implementation of FIG. 18.
Figure 18:
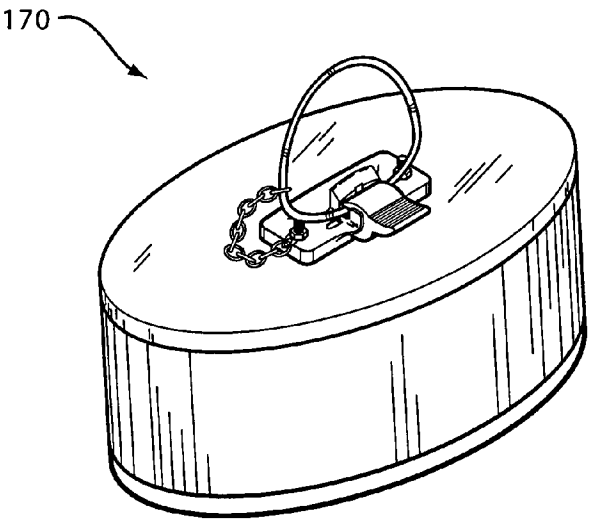
Figure 20:
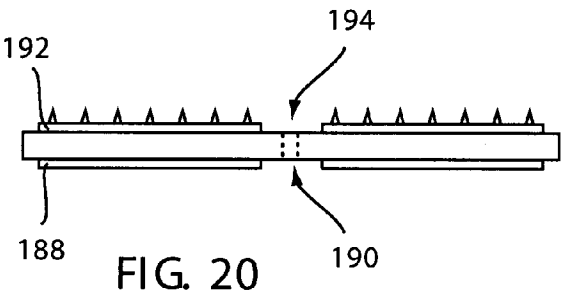

Although there are a variety of hold down implementations, for the exemplary purposes of this disclosure and referring to FIGS. 18–20, hold down 170 is an example of a hold down implementation. Hold down 170 is similar to hold downs 10, 120, and 130 as previously described. The principal difference between them, other than the shape of their respective weights, relates to their weights, versatility, and ease of use. In particular, weight 172 may include container 174 which has lid 176 and reversible base 184 coupled thereto. Container 122 forms an internal cavity for either removably storing a cheap material such as sand, dirt, water, stone, and the like, or for permanently storing a material such as cement, to achieve a desired hold down weight. Notwithstanding, weight 172 may not have container 174 and lid 176, but may be a solid piece formed at least in part of a heavy/weighted material. Weight 172 may also include external bottom cavity 178 and guide spline 180 with hole 182 therein. Reversible base 184 may include central through hole 186 that aligns with hole 182 and is secured by bolt 196 or some other fastener, as well as a pair of integral, dimpled pads 188 separated by central guide slot 190 on one side and a pair of integral, spiked or cleated areas 192 separated by central guide slot 194 on the opposing side. Dimpled pads 188 provide additional stability on hard surfaces, such as concrete, asphalt, wood, and the like surfaces that RV's typically park on, while cleated areas 192 provide additional stability on turf, lawn areas, other grassy surfaces, or the like for example. Notwithstanding, reversible base 184 may have as one side a pair of grid work areas similar to grid work 166 which would provide additional stability in soft sand, loose dirt, unstable wet soil, or the like for example. Hold down 170 also may include carry handle assembly 198 which may include D-shaped handle 200 and securing chain 202 coupling it to either latch assembly 16 or weight 170. Handle 200 may be removably inserted into latch assembly 16 similar to bar 50 of foot 46 when a user desires to carry hold down 170. Alternatively, a strap handle (e.g., a nylon strap handle) may be employed instead which may be coupled to either latch assembly 16 or weight 170.

Although there are a variety of hold down implementations, for the exemplary purposes of this disclosure any of the previously discussed components may be combined together to form other hold down implementations. For example, there could be multiple coupling mechanisms (whether the same or different) on the same hold down implementation.

Further implementations are within the CLAIMS.

3. Specifications, Materials, Manufacture, Assembly

It will be understood that hold down implementations are not limited to the specific components disclosed herein, as virtually any components consistent with the intended operation of a hold down implementation might be utilized. Accordingly, for example, although particular hold downs, weights, friction pads, latch assemblies, latch brackets, extension brackets, catches, holes, pins, hinge pins, threaded rods, threaded guide rods, wing nuts, screw knobs, threaded knobs, spring clips, securing tracks, containers, lids, hinges, retaining collars, cleats, grid works, and other components are disclosed, such components may comprise any shape, size, style, type, model, version, class, measurement, concentration, material, weight, quantity, and/or the like consistent with the intended operation of a hold down implementation. Implementations are also not limited to uses of any specific components, provided that the components selected are consistent with the intended operation of a hold down implementation.

Accordingly, the components defining any hold down implementation may be formed of any of many different types of materials or combinations thereof that can readily be formed into shaped objects provided that the components selected are consistent with the intended operation of a hold down implementation. For example, the components may be formed of: rubbers (synthetic and/or natural) and/or other like materials; glasses, such as fiberglass, carbon-fiber, aramid-fiber, and/or other like materials; polymers such as plastic, impact resistant plastic, PVC plastic, ABS plastic, polycarbonate, polystyrene, polypropylene, nylon, phenolics, Delrin®, any combination thereof, and/or other like materials; composites and/or other like materials; metals, such as zinc, magnesium, titanium, copper, iron, steel, stainless steel, any combination thereof, and/or other like materials; alloys, such as aluminum, and/or other like materials; cement, concrete, bricks, sand, dirt, water, stone, and/or other like materials; any other suitable material; and/or any combination thereof.

Furthermore, the components defining any hold down implementation may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, milling, drilling, stamping, cutting, welding, soldering, riveting, punching, and/or the like. If any of the components are manufactured separately, they may then be coupled with one another in any manner, such as with adhesive, a weld, a fastener (e.g. a bolt, a nut, a screw, a nail, a rivet, a pin, and the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

4. Use

Implementations are particularly useful in securing an RV awning in position. In describing the use of hold down implementations, with reference to FIGS. 2–6 and for the exemplary purposes of this disclosure, hold down 10 is shown in use with RV 30.

Figure 2:
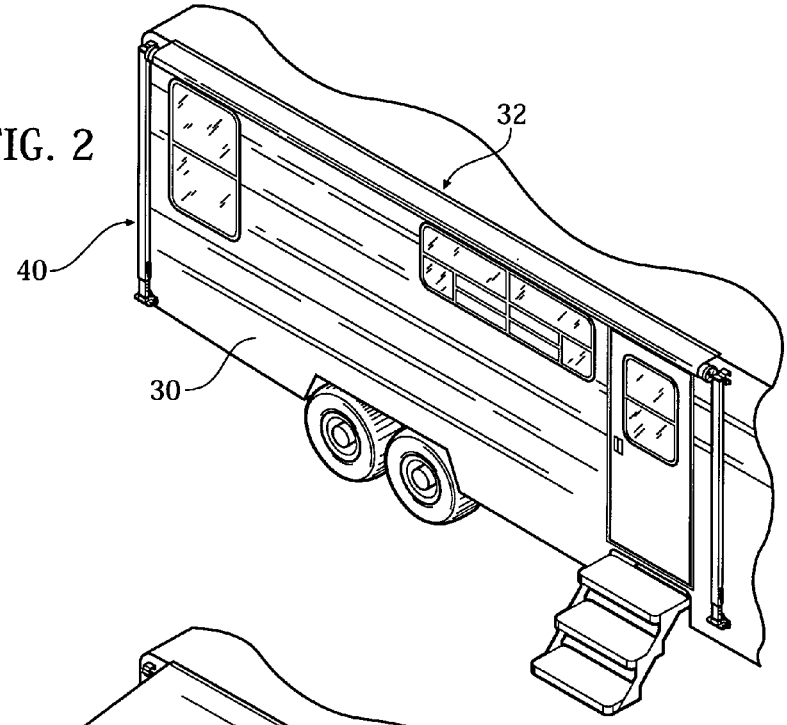
FIGS. 2–4 are perspective views of an RV awning and hold down assembly implementation during an RV awning holding method implementation.
Figure 3:
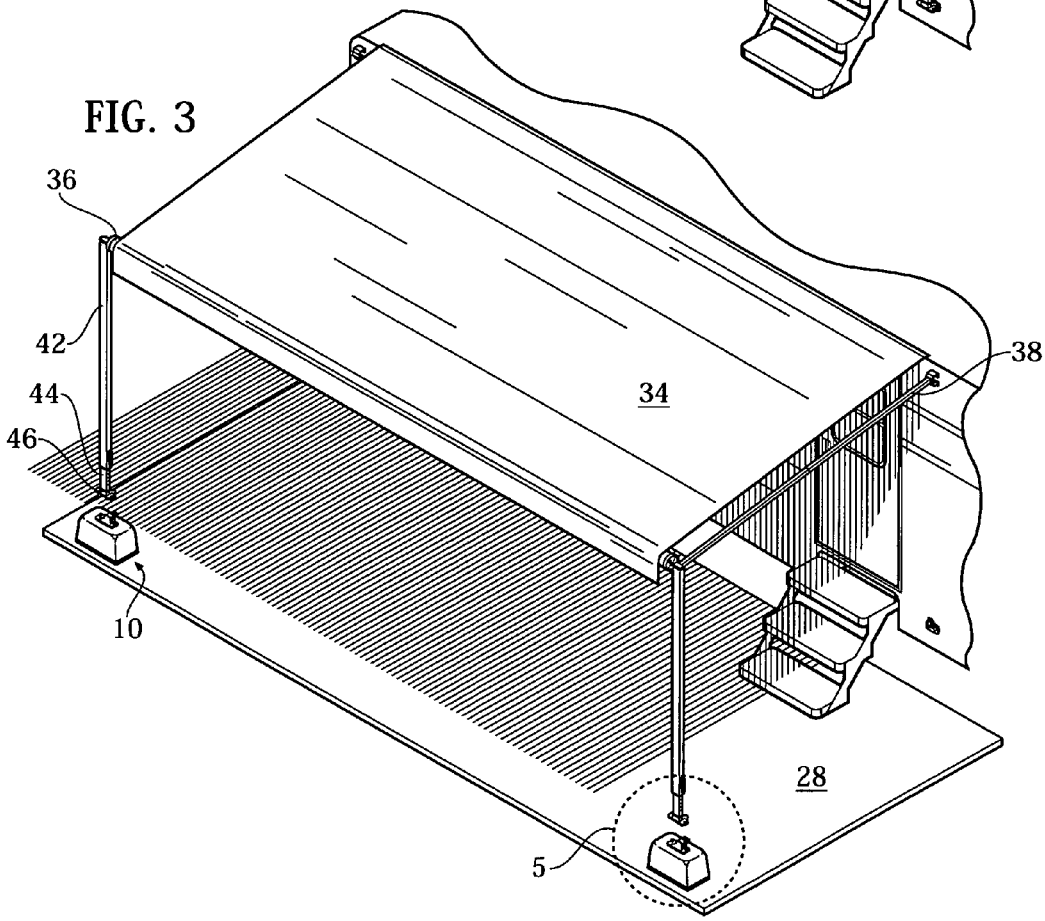
Figure 4:
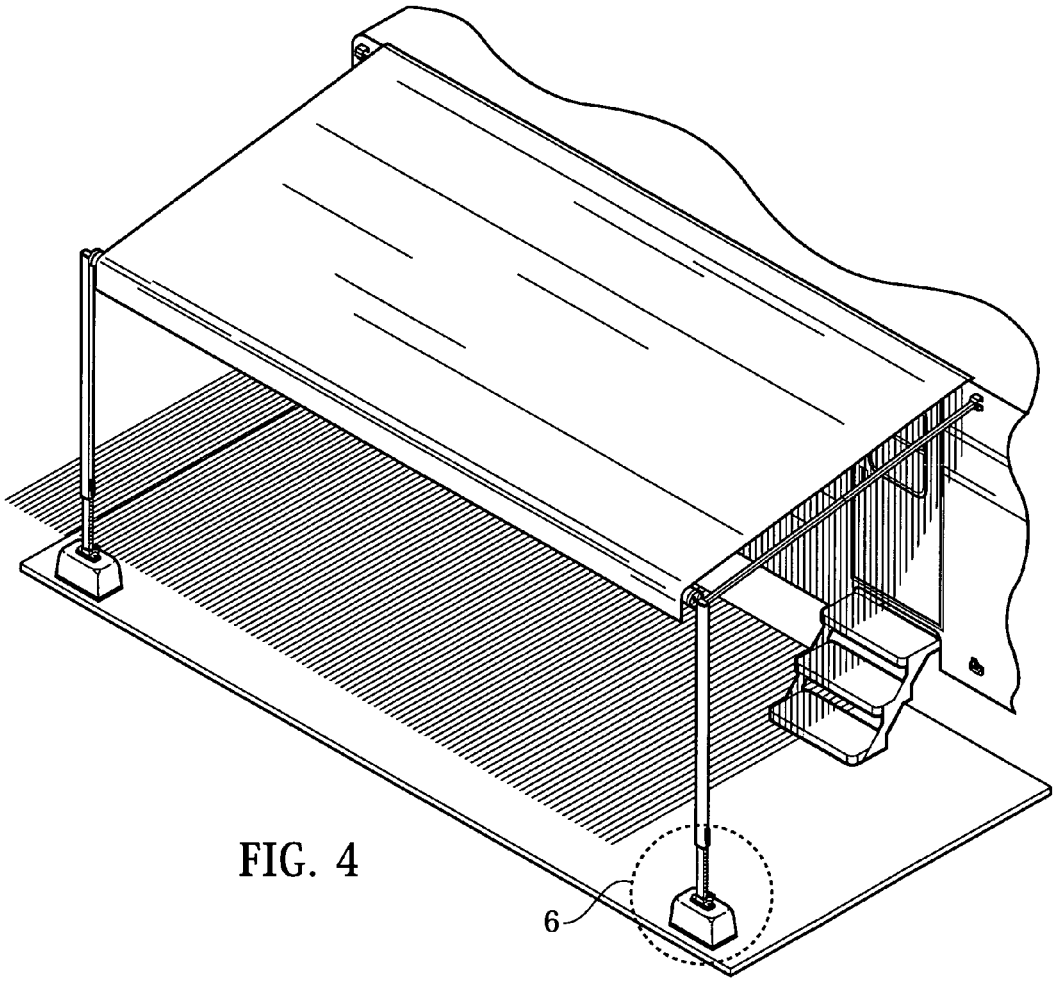

Generally, RV 30 may comprise awning assembly 32 which may include canopy 34 of generally rectangular configuration and roller or roll bar 36 onto which the outer edge of canopy 34 is secured. The inner edge of canopy 34 is connected to a side or top edge portion of RV 30. A pair of awning brace assemblies 38 located near the sides of canopy 34 each comprise two brace members which telescope with respect to one another. Awning brace assemblies 38 extend from the side of RV 30 to support arm assemblies 40 and/or roll bar 36 and hold support arm assemblies 40 in the extended positions and tension canopy 34. In a retracted position, awning brace assemblies 38 are stowed parallel with support arm assemblies 40, either nesting therein or on one side thereof. The top ends of a pair of support arm assemblies 40 are operatively connected at opposite axial ends of roll bar 36 to allow roll bar 36 to rotate relative to the pair of support arm assemblies 40. Support arm assemblies 40 generally vertically support roll bar 36 in both the retracted canopy position shown in FIG. 2 and the extended canopy position shown in FIGS. 3–4. Each support arm assembly 40 comprises upper arm 42 and lower arm 44 which telescope with respect to one another, and the length of which can be adjusted. In the extended position where canopy 34 is unrolled from roll bar 36, bottom foot 46 connected to each lower arm 44 is selectively pivotably connected to the side of RV 30 with support arm assemblies 40 pivoted away from the side of RV 30 when canopy 34 is in the patio position or disconnected from the side of RV 30 and aligned vertically to serve as support legs when canopy 34 is in the carport position as shown in FIGS. 3–4. Each foot 46 includes a pair of opposing protruding flanges extending from each side of lower arm 44 and bar 50 extending transversely across lower arm 44. Each protruding flange may define hole 48 therein.

Accordingly, hold down 10, or for that matter hold downs 120, 130, 150, and 170, may be used for securing RV awning assembly 32 of RV 30 in position in the following manner. First, canopy 34 may be placed in the carport position with canopy 34 unrolled from roll bar 36 and each bottom foot 46 disconnected from the side of RV 30 so that support arm assemblies 40 may serve as support legs as depicted in FIGS. 2–3. Second, bar 50 of foot 46 may be placed into a latching relationship with catch 22 of latch assembly 16 of hold down 10 as depicted in FIG. 4. As specifically depicted in FIGS. 5–6, the latching of bar 50 by catch 22 may be accomplished by using extension bracket 20 to guide bar 50 into a latching position with catch 22, moving each support arm assembly 40 to push bar 50 against catch 22, and using bar 50 to force catch 22 clockwise until bar 50 moves within the hook-shaped portion of catch 22 with the spring automatically moving catch 22 counterclockwise to connect around bar 50. In this manner, canopy 34 may be secured in its convenient/safe carport position during windy conditions for example no matter where RV 30 is parked, whether on concrete, asphalt, gravel, sand, rocky terrain, snow-covered terrain, frozen terrain, and the like for example. When RV 30 is ready to be moved, the installed hold downs 10 may be removed and canopy 34 brought back to its retracted position by reversing the foregoing steps.

While the use of hold down 10, or for that matter hold downs 120, 130, 150, and 170, has been described in a particular sequence of steps with reference to the drawing figures, it will be understood that the use of hold downs 10, 120, 130, 150, and 170, is not limited to the specific order of steps as disclosed. Any steps or sequence of steps of the use of hold downs 10, 120, 130, 150, and 170 indicated herein are given as examples of possible steps or sequence of steps and not as limitations, since various processes and sequences of steps may be used to secure RV awning assembly 32 in position. For example, an operator does not always have to use a pair of either hold downs 10, 120, 130, 150, and 170, but may use only one hold down 10, 120, 130, 150, and 170 if desired and leave one support arm assembly 40 coupled to the side of RV 30.

Furthermore, other hold down implementations may be used in similar manners to secure RV awning assemblies.

By way of example and not by way of limitation, hold down 90 may be used for securing RV awning assembly 32 of RV 30 in position in a manner similar to those for hold downs 10, 120, 130, 150, and 170 as previously described. The principal differences between them relate to the coupling of foot 46 of support arm assembly 40. In particular, foot 46 may be removably coupled to hold down 90 by inserting bar 50 of foot 46 into spring-clip 94.

By way of example and not by way of limitation, hold downs 60, 140, and 160 may be used for securing RV awning assembly 32 of RV 30 in position in manners similar to that for hold downs 10, 120, 130, 150, and 170 as previously described. The principal differences between them relate to the coupling of foot 46 of support arm assembly 40. In particular, each foot 46 may be removably coupled to hold downs 60, 140, and 160 by inserting threaded rods 64 and threaded guide rods 144 of hold downs 60 and 160 and 140 respectively through the corresponding holes 48 defined through the opposing protruding flanges of foot 46 and then securing wing nut 66, threaded knob 148, or some other nut, thumb nut, or the like on each threaded rod 64 or threaded guide rod 144.

By way of example and not by way of limitation, hold down 80 may be used for securing RV awning assembly 32 of RV 30 in position in manners similar to that for hold downs 60, 140, and 160 as previously described. The principal differences between them relate to the coupling of foot 46 of support arm assembly 40. In particular, foot 46 may be removably coupled to hold down 80 by inserting hinge pins 84 through corresponding opposing through holes 48 of foot 46 and then folding over hinge pins 84.

By way of example and not by way of limitation, hold down 70 may be used for securing RV awning assembly 32 of RV 30 in position in manners similar to that for hold downs 60, 140, and 160 as previously described. The principal differences between them relate to the coupling of foot 46 of support arm assembly 40. In particular, foot 46 may be removably coupled to hold down 70 by aligning threaded holes 74 with corresponding opposing through holes 48 of foot 46 and then securing screw knob 76 or some other bolt, thumb screw, or the like into each threaded hole 74.

By way of example and not by way of limitation, hold downs 100 and 110 may be used for securing RV awning assembly 32 of RV 30 in position in manners similar to that for hold downs 10, 120, 130, 150, and 170 as previously described. The principal differences between them relate to the coupling of foot 46 of support arm assembly 40. In particular, each foot 46 may be removably coupled to hold downs 100 and 110 by inserting foot 46 into securing tracks 104 and 114.

The invention claimed is:

1. A hold down for securing an RV awning assembly in position, the hold down comprising:

a weight associated with a coupling mechanism that is configured to removably couple to a foot of an awning support arm assembly, wherein the weight comprises a thickness that separates a top surface and a bottom surface, and wherein the weight comprises one of:

a first container having a lid pivotally coupled there to, the first container removably storing a material to achieve a desired hold down weight;

a second container having a screw on lid, the second container removably storing a material to achieve a desired hold down weight; and an adjustable weight system comprising a plurality of flat weights stacked in layers to achieve a desired hold down weight; and a friction pad coupled to or integrally joined with one of a portion of the bottom surface of the weight, portions of the bottom surface of the weight, and the entire bottom surface of the weight; and one of a first retaining collar comprising a plurality of cleats, the first retaining collar removably coupled with a bottom portion of the weight; and a second retaining collar comprising a grid work, the second retaining collar removably coupled with a bottom portion of the weight.

2. The hold down of claim 1, wherein the friction pad is one of compressible, ribbed, dimpled, and a combination thereof.

3. A hold down for securing an RV awning assembly in position, the hold down comprising a weight associated with a coupling mechanism that is configured to removably couple to a foot of an awning support arm assembly, wherein the weight comprises a reversible base, and wherein the coupling mechanism comprises a latch assembly comprising a spring-biased catch, the latch assembly coupled to the weight.

4. The hold down of claim 3, wherein the reversible base comprises one of at least one friction pad and at least one integral, dimpled pad on one side thereof and one of at least one cleated area and at least one grid work area on an opposing side thereof.

5. The hold down of claim 4 further comprising a carry handle assembly.

6. The hold down of claim 5, wherein the carry handle assembly comprises one of:

a D-shaped handle and a securing chain, the securing chain coupled to both the handle and one of the latch assembly and the weight; and a strap handle coupled to one of the latch assembly and the weight.

7. A RV awning and hold down system comprising:

an awning assembly comprising at least one support arm assembly disconnected from a side of an RV, the at least one support arm assembly comprising a foot having a bar; and at least one hold down comprising a weight associated with a coupling mechanism, the coupling mechanism removably coupled to the foot of the at least one support arm assembly, wherein the coupling mechanism comprises one of:

a latch assembly coupled to the weight, the latch assembly comprising a spring-biased catch, wherein the spring-biased catch is removably coupled with the bar of the foot; and a spring-clip coupled to the weight, wherein the spring-clip is removably coupled with the bar of the foot.

8. The assembly of claim 7, wherein the awning assembly comprises a pair of support arm assemblies disconnected from a side of an RV, and wherein the at least one hold down comprises a pair of hold downs.

* * * * *